US010442661B2

(12) United States Patent
Shi et al.

(10) Patent No.: US 10,442,661 B2
(45) Date of Patent: Oct. 15, 2019

(54) GOVERNOR OF ELEVATOR

(71) Applicant: Otis Elevator Company, Farmington, CT (US)

(72) Inventors: Zhengbao Shi, Shanghai (CN); Zhihuan Man, Shanghai (CN); Yong Zhao, Shanghai (CN); Min Wang, Shanghai (CN); Ye Li, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 249 days.

(21) Appl. No.: 15/662,508

(22) Filed: Jul. 28, 2017

(65) Prior Publication Data

US 2018/0029828 A1 Feb. 1, 2018

(30) Foreign Application Priority Data

Aug. 1, 2016 (CN) ..... 2016 1 0616858

(51) Int. Cl.

| | |
|---|---|
| ***B66B 5/04*** | (2006.01) |
| *B66B 1/32* | (2006.01) |
| *B66B 5/06* | (2006.01) |

(52) U.S. Cl.

CPC ..... *B66B 5/044* (2013.01); *B66B 1/32* (2013.01); *B66B 5/06* (2013.01)

(58) Field of Classification Search

CPC ..... B66B 5/044; B66B 1/32; B66B 5/06
See application file for complete search history.

(56) References Cited

U.S. PATENT DOCUMENTS

| | | | | |
|---|---|---|---|---|
| 2,262,366 A * | 11/1941 | McCormick | B66B 5/044 192/147 |
| 5,065,845 A * | 11/1991 | Pearson | B66B 5/044 187/376 |
| 5,492,200 A * | 2/1996 | Korhonen | B66B 5/044 187/350 |
| 5,565,660 A * | 10/1996 | Kerner | B66B 5/044 187/276 |
| 5,653,312 A * | 8/1997 | Kato | B66B 5/044 187/350 |
| 7,537,090 B2 * | 5/2009 | Vantanen | B66B 5/04 187/286 |

(Continued)

FOREIGN PATENT DOCUMENTS

| | | |
|---|---|---|
| CN | 101780910 A | 7/2010 |
| CN | 103010890 A | 4/2013 |

(Continued)

OTHER PUBLICATIONS

European Search Report for application EP 17184347.7, dated Jan. 25, 2018, 7 pages.

*Primary Examiner* — Michael A Riegelman
(74) *Attorney, Agent, or Firm* — Cantor Colburn LLP

(57) ABSTRACT

The present invention relates to the technical field of an elevator, and provides a governor of an elevator. The governor of the present invention is provided with a reset push part which is disposed on a ratchet wheel and is used for resetting the governor from a second state to a first state, wherein the reset push part and a pawl of the governor are set in such a manner that when a rope sheave rotates in a direction, the reset push part pushes the pawl to reset the pawl to a position corresponding to the first state.

25 Claims, 10 Drawing Sheets

(56) References Cited

U.S. PATENT DOCUMENTS

| | | | | |
|---|---|---|---|---|
| 7,753,176 | B2 * | 7/2010 | Kigawa | B66B 5/06 187/280 |
| 8,887,791 | B2 | 11/2014 | Eiterman et al. | |
| 10,150,648 | B2 * | 12/2018 | Shen | B66B 7/068 |
| 2003/0042079 | A1 * | 3/2003 | Sanchez | B60T 1/062 187/373 |
| 2011/0272217 | A1 * | 11/2011 | Niikawa | B66B 5/044 187/305 |
| 2012/0006630 | A1 * | 1/2012 | Wang | B66B 5/044 187/350 |
| 2012/0312638 | A1 * | 12/2012 | Muller | B66B 5/044 187/287 |
| 2015/0329322 | A1 | 11/2015 | Osmanbasic et al. | |
| 2017/0190545 | A1 * | 7/2017 | Dube | B66B 5/044 |
| 2018/0118515 | A1 * | 5/2018 | Shi | B66B 5/02 |

FOREIGN PATENT DOCUMENTS

| | | | |
|---|---|---|---|
| CN | 103508289 | A | 1/2014 |
| CN | 103508290 | A | 1/2014 |
| CN | 103508291 | A | 1/2014 |
| CN | 103523628 | A | 1/2014 |
| CN | 103523629 | A | 1/2014 |
| CN | 103523632 | A | 1/2014 |
| CN | 103991770 | A | 8/2014 |
| CN | 104355197 | A | 2/2015 |
| CN | 104709792 | A | 6/2015 |
| CN | 104787638 | A | 7/2015 |
| CN | 204490245 | U | 7/2015 |
| EP | 1598300 | A1 | 11/2005 |
| EP | 2020396 | A1 | 2/2009 |

* cited by examiner

GOVERNOR OF ELEVATOR

PRIORITY

This application claims priority to Chinese Patent Application No. CN201610616858.X , filed Aug. 1, 2016, and all the benefits accruing therefrom under 35 U.S.C. § 119, the contents of which in its entirety are herein incorporated by reference.

TECHNICAL FIELD

The present invention relates to the technical field of an elevator, to an elevator governor, and in particular, to a governor that does not need to be reset manually.

BACKGROUND

Installation apparatuses for an elevator include a safety gear, a governor, and the like. These apparatuses enable a car of the elevator to brake emergently when the car exceeds a particular speed, to avoid an extreme accident such as freefall of the car.

An existing governor mainly has the following two functions: In the first aspect, the governor triggers an electrical switch to disconnect a safety circuit when the car accelerates to a first limiting speed, so as to brake the car by using a holding brake of a traction machine. In the second aspect, if braking in the previous first aspect fails and the car continues to accelerate to a second limiting speed (the second limiting speed is greater than the first limiting speed), the governor draws a steel rope connected to a wedge of the safety gear, to actuate the safety gear, thereby braking the car thoroughly. The function in the second aspect needs to be implemented mechanically, so as to ensure extremely high reliability.

However, after completing the functions in the foregoing two aspects once, the governor needs to be reset to an original position so that it can still complete the functions in the foregoing two aspects during a subsequent operation process of the elevator. Especially, the governor needs to be mechanically reset to restore the function in the second aspect.

For an elevator in which the governor is installed at a position easily reachable to an operator, that is, for an elevator with a machine room, it is relatively easy to implement mechanical reset of the function in the second aspect. However, for an elevator in which the governor is installed at a position difficult to reach or unreachable for an operator, that is, for a machine room-less (MRL) elevator, implementation of the mechanical reset of the function in the second aspect needs to completely rely on the governor, that is, mechanical reset is implemented without a manual operation.

SUMMARY OF THE INVENTION

An objective of the present invention is to provide a governor which can implement mechanical reset without a manual operation.

To achieve the above objective or other objectives, the present invention provides following technical solutions.

According to a first aspect of the present invention, a governor of an elevator is provided, which includes a rope sheave; a ratchet wheel; and a centrifugal mechanism, a trip bar, and a rotatable pawl which are mounted on the rope sheave, the governor being able to work in a first state in which the rope sheave freely rotates with respect to the ratchet wheel or in a second state in which a safety gear is actuated; in the second state, the pawl being located in a first position in which a pawl head thereof mechanically acts on the ratchet wheel, so that rotation of the rope sheave in a first direction can act on the ratchet wheel via the pawl head, wherein the governor further includes a reset push part which is disposed on the ratchet wheel and used for resetting the governor from the second state to the first state, wherein the reset push part and the pawl are set in such a manner that when the rope sheave rotates in a second direction opposite to the first direction, the reset push part pushes the pawl to reset the pawl to a position corresponding to the first state.

According to another aspect of the present invention, an elevator is provided, which uses the governor described above.

The foregoing features and operations of the present invention will become more evident according to the following description and the accompanying drawings.

DESCRIPTION OF THE DRAWINGS

In the following detailed description with reference to the accompanying drawings, the foregoing and other objectives and advantages of the present invention are clearer and more complete, wherein identical or similar elements are indicated with identical reference numerals.

Meanings of Reference Numerals

Figure 1:
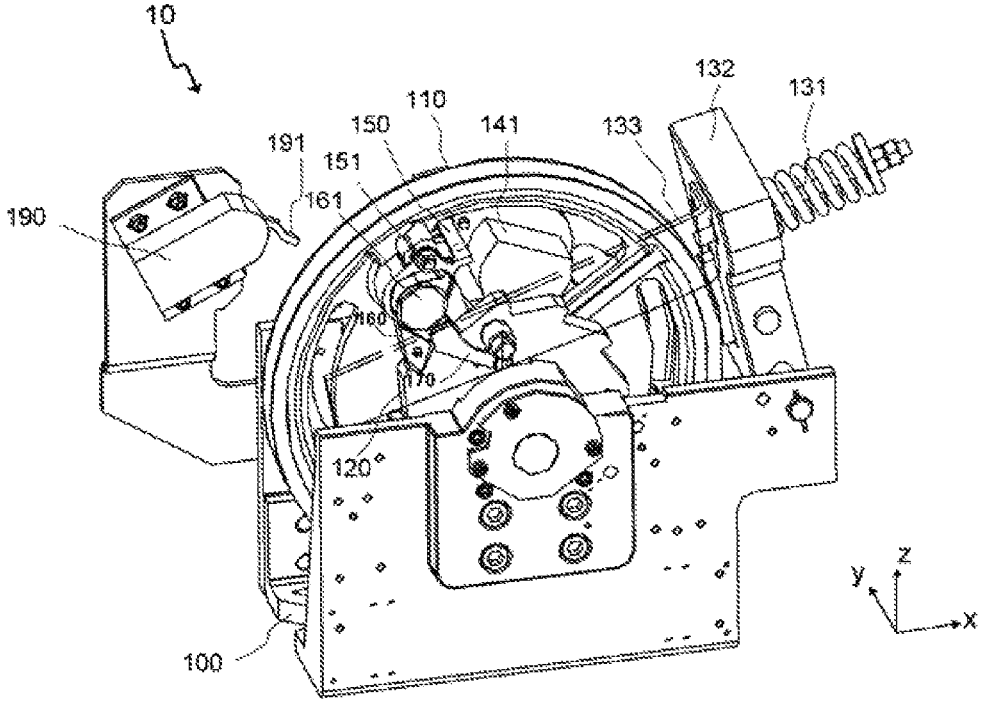
FIG. 1 is a three-dimensional schematic structural diagram of a governor according to a first embodiment of the present invention, wherein the governor works in a second state.

10, 20 governor
100 rack
110 rope sheave
120 ratchet wheel
131 braking spring
132 rope-pressing holder
133 pull rod
140 centrifugal mechanism
141 centrifugal swing component
150 trip bar

151, 161, 171, 271 pivotal shaft
152 protruding stop portion
153 torsion spring
160 pawl
161 pivotal shaft
162 reset pin
163 pawl head
164 pawl tail
165 tension spring
170, 270 reset push part
172, 272 push portion
173 first rotation limiting portion
174 second rotation limiting portion
190 electrical switch
191 trigger arm
273 push rod tail
280 reset tension spring

DETAILED DESCRIPTION OF THE EMBODIMENTS

The present invention will be described more comprehensively herein with reference to the accompanying drawings, wherein the accompanying drawings show exemplary embodiments of the present invention. However, the present invention can be implemented in different forms, and should not be construed as being limited to the embodiments illustrated herein. On the contrary, these provided embodiments make the disclosure thorough and complete, and fully convey the concept of the present invention to persons skilled in the art. In the accompanying drawings, identical numerals refer to identical elements or parts, and therefore, their descriptions will be omitted.

In the following description, to make the description clear and concise, not all of the parts shown in the figures are described in detail. The accompanying drawings show multiple parts which can be used by persons with ordinary skill in the art to implement the present invention, and operations of many parts are familiar and obvious to persons skilled in the art.

In the following description, for convenience, a direction of a rotation axis of a rope sheave of a governor is defined as y direction, a transverse direction of the governor is defined as x direction, and a longitudinal direction of the governor is defined as z direction. It should be appreciated that, definitions of these directions are used for relative descriptions and explanations and may be correspondingly changed according to a position change of the governor.

First Embodiment

A governor 10 of an elevator in the embodiment of the present invention is described in detail below with reference to FIG. 1 to FIG. 10 by using examples.

In this embodiment, the governor 10 is used for triggering corresponding operations when a car of the elevator exceeds a predetermined speed, to limit the speed of the car of the elevator. Therefore, the governor 10 in this embodiment is provided with a rope sheave 110 for monitoring an operation speed of the ca. A steel rope (not shown in the figures) is disposed in a rope sheave groove of the rope sheave 110, and when the elevator is in a normal operation condition, the steel rope is basically synchronized with the monitored car in the vertical movement, and drives the rope sheave 110 to rotate simultaneously. For example, when the car goes up, the rope sheave 110 rotates in a counterclockwise direction shown in FIG. 1; and on the contrary, when the car goes down, the rope sheave 110 rotates in a clockwise direction shown in FIG. 1.

The governor 10 is further provided with a ratchet wheel 120 and a centrifugal mechanism 140 (refer to FIG. 5), and the ratchet wheel 120 and the rope sheave 110 are both disposed on a rack 100 of the governor 10. In this embodiment, the ratchet wheel 120 and the rope sheave 110 may be disposed coaxially, but the ratchet wheel 120 stays still when the elevator is in the normal operation condition. Several ratchet grooves are provided on the circumference of the ratchet wheel 120. An outer diameter of the ratchet wheel 120 is obviously less than that of the rope sheave 110, and the ratchet wheel 120 is disposed on one axial side of the ratchet wheel 120. The centrifugal mechanism 140 may be disposed on the ratchet wheel 120 and located on the other axial side of the ratchet wheel, that is, located on a side opposite to the side provided with the ratchet wheel 120.

The centrifugal mechanism 140 is provided with a centrifugal swing component 141. The centrifugal mechanism 140 starts to work while the ratchet wheel 120 rotates, and as the ratchet wheel 120 accelerates, the centrifugal swing component 141 of the centrifugal mechanism 140 moves, within the ratchet wheel 120, closer to the circumference of the ratchet wheel 120. That is, as the ratchet wheel 120 accelerates, the centrifugal swing component 141 can outwardly reach a farther position in a radial direction of the ratchet wheel 120. In this way, the governor 10 can monitor an operation speed of the car by using the centrifugal mechanism 140. It should be noted that, a specific implementation structure of the centrifugal mechanism 140 is not limited in the embodiment of the present invention. The main function of the centrifugal mechanism 140 is that its action corresponds to a rotation speed of the ratchet wheel 120 and it can mechanically trigger corresponding parts of the governor 10 when the ratchet wheel reaches a particular speed. Any centrifugal mechanism which can implement this function can be used in the governor 10 of the present invention.

In this embodiment, the governor 10 can optionally implement the following function: preventing the elevator from further speeding up when an operation speed of the car of the elevator is greater than or equal to a first limiting speed.

Therefore, an electrical switch 190 is disposed on the governor 10. Specifically, the electrical switch 190 is provided with a protruding trigger arm 191 facing the rope sheave 110. When the operation speed of the car reaches the first limiting speed, a tail end of the centrifugal swing component 141 can reach a first radial position in a radial direction of the rope sheave 110, rotate, and mechanically act on the trigger arm 190 in the first radial position, to trigger the electrical switch 190 to disconnect a safety circuit, so as to brake the car by using, for example, a holding brake of a traction machine.

In this embodiment, the governor 10 can further implement the following function: mechanically actuating a safety gear disposed on the car when the operation speed of the car of the elevator is greater than or equal to a second limiting speed, so as to brake the car emergently. The reason is that, the electrical switch 190 probably fails to operate normally and becomes unreliable when braking is triggered by using the electrical switch 190. Therefore, the governor 10 needs to actuate the safety gear in a completely mechanical manner, to avoid an extreme accident, such as the falling of the car, in the most reliable manner. The second limiting speed is greater than the first limiting speed, and their values may be correspondingly set according to a specific application of the elevator.

Figure 2:
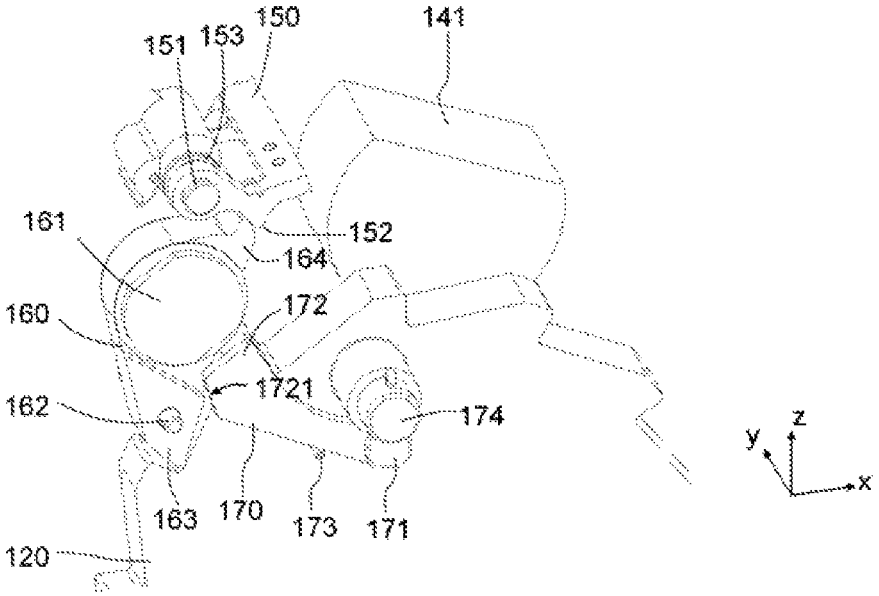
FIG. 2 is a three-dimensional schematic structural diagram of key parts of the governor shown in FIG. 1.
Figure 3:
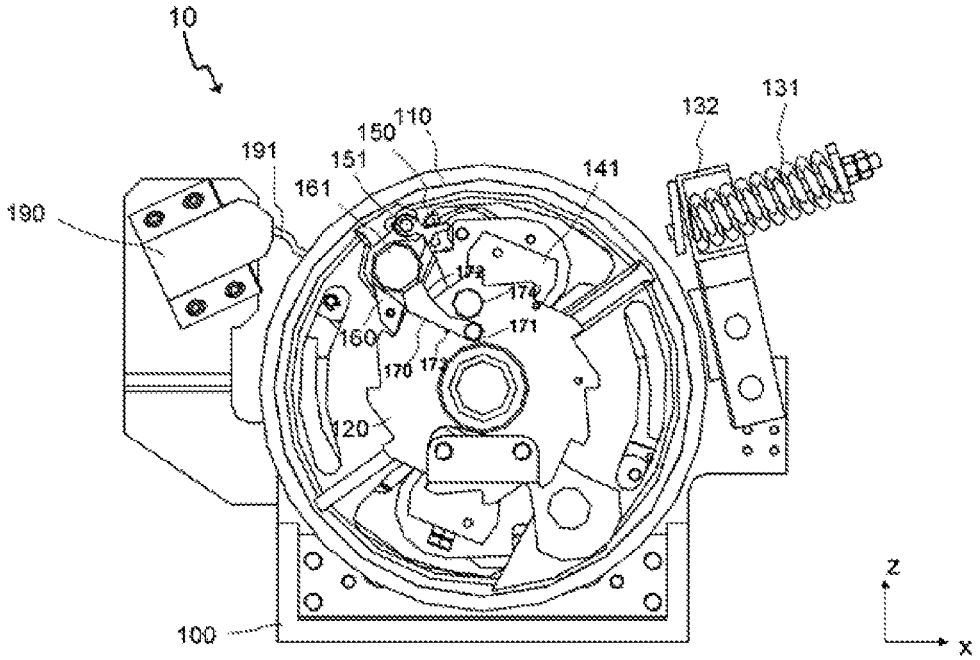
FIG. 3 is a front view of the governor shown in FIG. 1.
Figure 4:
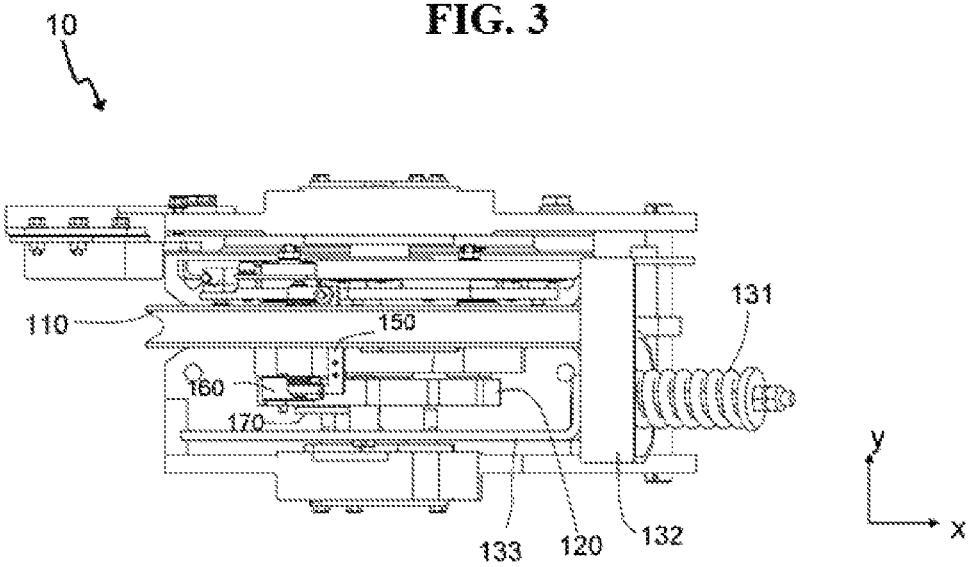
FIG. 4 is a top view of the governor shown in FIG. 1.
Figure 5:
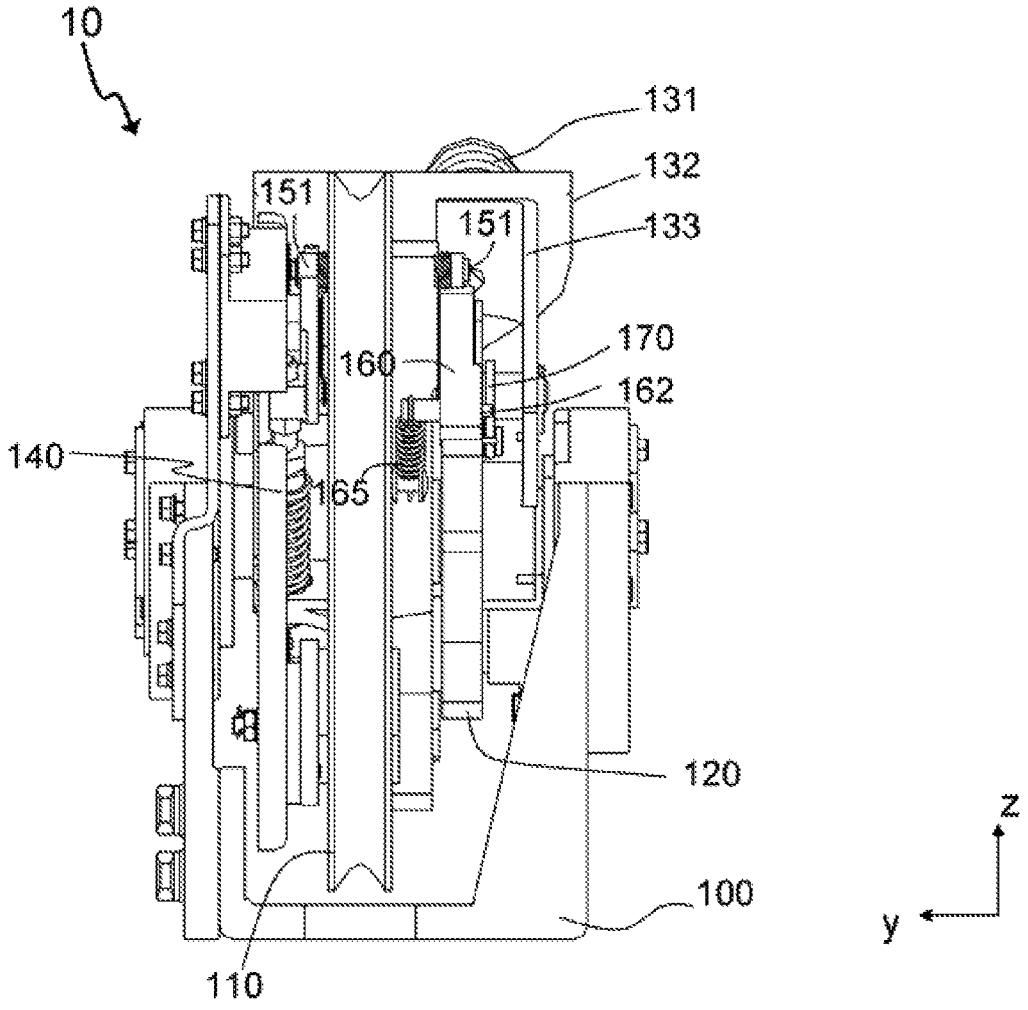
FIG. 5 is a left view of the governor shown in FIG. 1.

Therefore, the governor 10 is provided with corresponding parts for mechanically actuating the safety gear, specifically including a trip bar 150 and a pawl 160 which are disposed on the rope sheave 110, and further including a braking spring 131, a rope-pressing holder 132, and a pull rod 133. In one embodiment, the trip bar 150 is disposed near an edge of the circumference of the rope sheave 110 and can rotate with respect to the rope sheave 110, and a pivotal shaft 151 of the trip bar is disposed on the rope sheave 110 along a y direction. The pawl 160 is disposed near the trip bar 150 and on the same side with the ratchet wheel 120, and can rotate with respect to the rope sheave 110. A pivotal shaft 161 of the pawl is disposed on the rope sheave 110 along the y direction. Two ends of the pawl 160 are a pawl head 163 and a pawl tail 164 respectively, which can both rotate about the pivotal shaft 161. When the operation speed of the car reaches the second limiting speed, the tail end of the centrifugal swing component 141 can reach a second radial position (the second radial position is farther away from an axial center of the rope sheave 110 than the first radial position) in the radial direction of the rope sheave 110, rotate, and mechanically act on the trip bar 150 in the second radial position. The trip bar 150 then triggers the pawl 160 to rotate, and the pawl head 163 falls into the ratchet groove (as shown in FIG. 1 and FIG. 2) of the ratchet wheel 120. At this time, the rotation of the rope sheave 110 is limited by the ratchet wheel 120 and the rope sheave 110 exerts a reaction force on the ratchet wheel 120. The ratchet wheel 120 transfers the reaction force to the pull rod 133, to draw the rope-pressing holder 132 closer to the rope sheave 110 till it presses against the steel rope of the rope sheave 110. A friction between the rope-pressing holder 132 and the steel rope may be converted into an upward pull force acting on the steel rope. Therefore, the safety gear disposed on the other end of the steel rope may be actuated under the effect of the pull force, to achieve emergency braking. The rope-pressing holder 132 may be specifically a U-shaped box.

Figure 6:
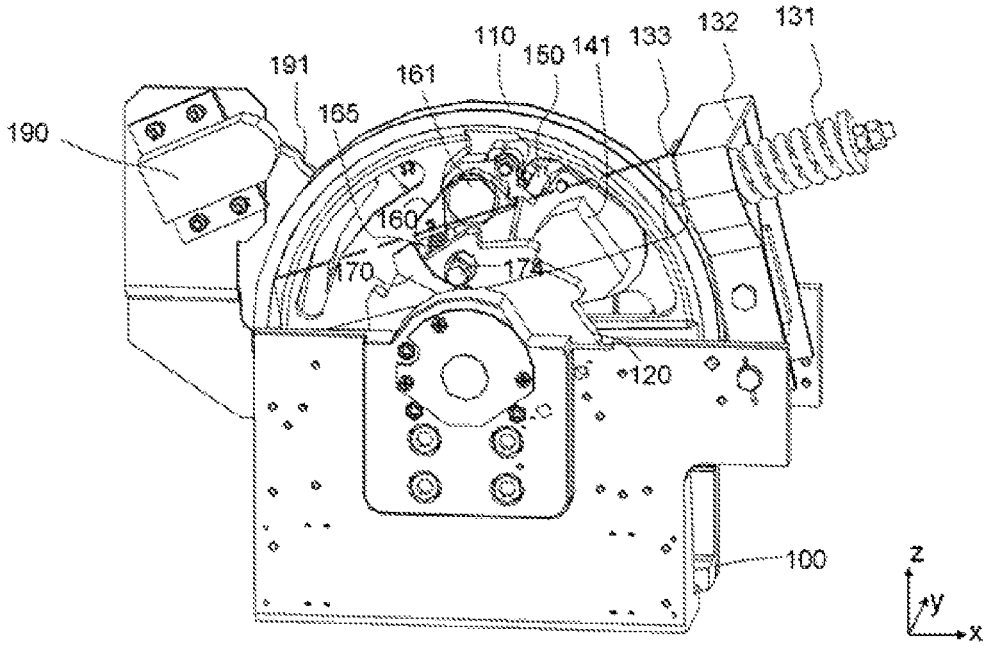
FIG. 6 is a three-dimensional schematic structural diagram showing that the governor shown in FIG. 1 works in a first state.
Figure 7:
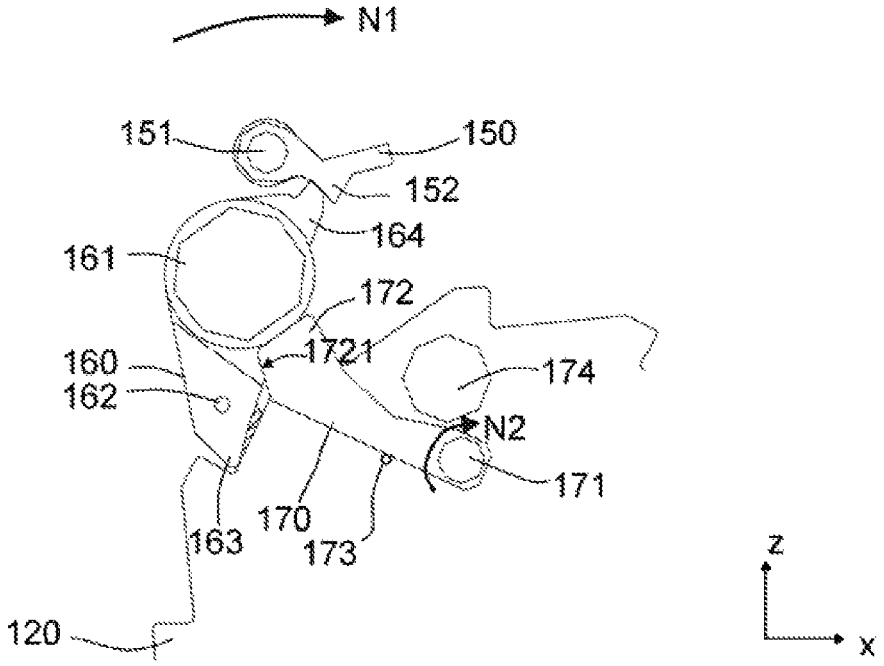
FIG. 7 to FIG. 10 show a resetting operation process in which the governor in the first embodiment of the present invention is reset from the second state shown in FIG. 1 to the first state shown in FIG. 6.
Figure 10:
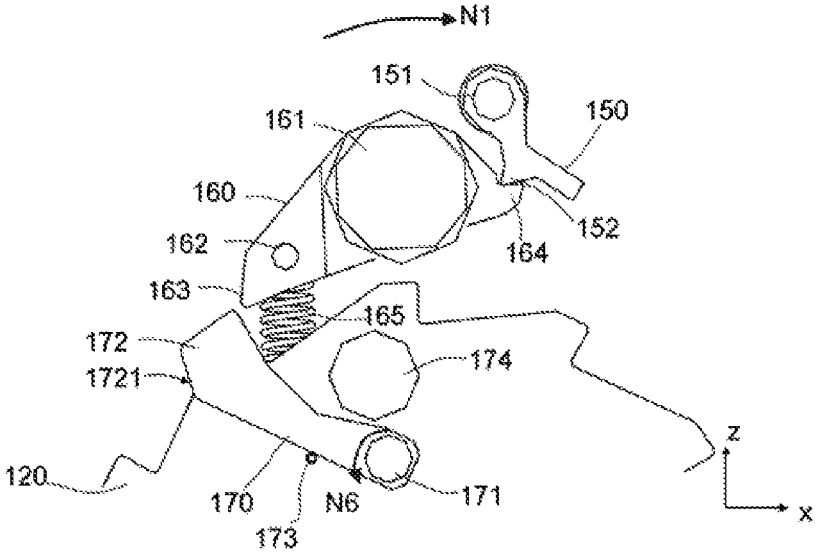

Herein, a first state and a second state of the governor 10 are defined. In the first state (as shown in FIG. 6 and FIG. 10), the rope sheave 110 can freely rotate with respect to the ratchet wheel 120, and correspondingly, an operation speed of the car is less than the aforementioned second limiting speed. In the second state (as shown in FIG. 1 and FIG. 7), the pawl 160 is located in a first position in which a pawl head 163 thereof mechanically acts on the ratchet wheel 120, so that rotation of the rope sheave 110 in a first direction (for example, the counterclockwise direction in FIG. 1) can act on the ratchet wheel 120 via the pawl head 163. In the second state, rotation of the rope sheave 110 is obviously limited by the ratchet wheel 120, thereby producing the pull force.

In one embodiment, specific structures of the trip bar 150 and the pawl 160 are set as shown in FIG. 2 and FIG. 7 to FIG. 10. The whole trip bar 150 rotates about the pivotal shaft 151, and therefore can rotate with respect to the rope sheave 110. The trip bar 150 is provided with a protruding stop portion 152 facing the pawl tail 164 of the pawl 160. In the first state shown in FIG. 6, the protruding stop portion 152 may limit the pawl 160 in a second position and stop the pawl 160 from rotating, wherein the pawl 160 can freely rotate with respect to the ratchet wheel 120 in the second position. Correspondingly, the pawl tail 164 on one end of the pawl 160 may specifically be, but not limited to, hook-shaped. In the first state (as shown in FIG. 10), an inner side of the hook of the pawl tail 164 interacts with an outer side of the protruding stop portion 152 of the trip bar 150; and in the second state (as shown in FIG. 7), an outer side of the hook of the pawl tail 164 interacts with an inner side of the protruding stop portion 152 of the trip bar 150.

Figure 8:
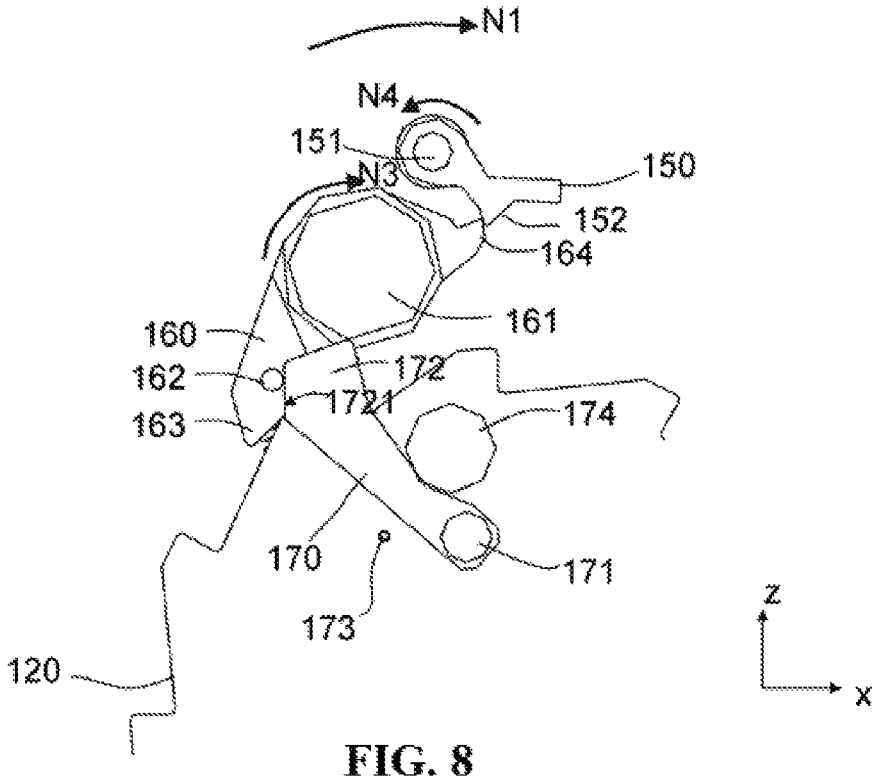
Figure 9:
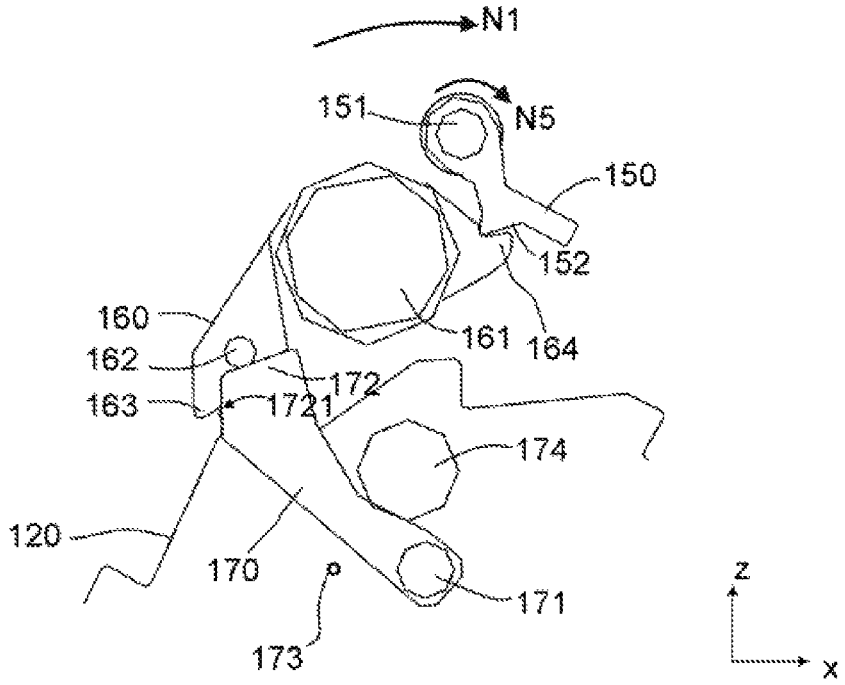

Moreover, in this embodiment, a torsion spring 153 corresponding to the trip bar 150 is disposed on the pivotal shaft 151 of the trip bar, and under the effect of a force exerted by the torsion spring 153, the trip bar 150 may rotate about the pivotal shaft 151 at a particular angle in a direction N5 shown in FIG. 9. A tension spring 165 corresponding to the pawl 160 is disposed on the pawl head 163, and under the effect of a force exerted by the tension spring 165, the pawl 160 may be pulled to rotate about the pivotal shaft 161 at a particular angle in a direction opposite to a direction N3, as shown in FIG. 8.

Specifically, when the elevator is in a normal operation condition, the governor 10 is in the first state; and blocked by the trip bar 150, the pawl 160 is located in the second position. When the operation speed of the car reaches the second limiting speed, the centrifugal swing component 141 swings outwardly to a second radial position in which the trip bar 150 can be triggered at this time, and drives the trip bar 150 to rotate at a particular angle in a direction N4 shown in FIG. 8, till the protruding stop portion 152 of the trip bar 150 cannot block the pawl tail 164 of the pawl 160. In this case, the tension spring 165 pulls the pawl 160 to rotate about the pivotal shaft 161 at a particular angle in a direction opposite to the direction N3, as shown in FIG. 8. The pawl head 163 of the pawl 160 falls into the ratchet groove of the ratchet wheel 120, the pawl 160 is located in the first position, and correspondingly, the governor 10 is in the second state. In the process illustrated above, the governor 10 completes a mechanical setting operation. A basic process is as follows: After the car reaches the second limiting speed, the trip bar 150 is triggered by the centrifugal swing component 141, and the pawl 160 rotates at a particular angle in the second position to jump to the first position.

Continue to refer to FIG. 1 to FIG. 10. The governor 10 in the embodiment of the present invention further has an automatic mechanical resetting function. A resetting process refers to that the governor 10 returns from the second state shown in FIG. 1 to the first state shown in FIG. 6, and correspondingly, the pawl 160 rotates at a particular angle in the first position and then returns to the second position.

Therefore, in the governor 10 in this embodiment, the ratchet wheel 120 is further provided with a reset push part 170 for resetting the governor 10 from the second state to the first state. In this embodiment, one end of the reset push part 170 is rotatably fixed on the ratchet wheel 120 by using the pivotal shaft 171. The ratchet wheel 120 is further provided with a first rotation limiting portion 173 and a second rotation limiting portion 174, and by the first rotation limiting portion 173 and the second rotation limiting portion 174, the reset push part 170 is limited to rotating within a particular angle range. The angle range within which the reset push part 170 rotates may be set by setting positions of the first rotation limiting portion 173 and the second rotation limiting portion 174 with respect to the pivotal shaft 171. The other end of the reset push part 170 is a push portion 172, and the pawl 160 is provided with a reset pin 162 corresponding to the push portion 172 of the reset push part 170. The reset pin 162 is disposed in a certain position on the pawl head 163.

The resetting operation process of the governor 10 in the embodiment of the present invention is described by using an example below with reference to FIG. 7 to FIG. 10. Furthermore, specific settings and operation principles of the reset push part 170 and other parts are described.

First, the rope sheave 110 may be driven to rotate in a direction N1; the trip bar 150 and the whole pawl 160 rotate with respect to the ratchet wheel also in the direction N1, and reach a position shown in FIG. 7 after completing one revolution at a position shown in FIG. 10 (a position where the resetting operation is just completed) with respect to the reset push part 170. In this process, the reset push part 170 is located, under its own gravity, in an angular position defined by the first rotation limiting portion 173.

When the rope sheave 110 continues to rotate in the direction N1, the reset pin 162 on the pawl 160 drives the reset push part 170 to rotate in a direction N2 shown in FIG. 7, till the reset push part 170 reaches an angular position defined by the second rotation limiting portion 174 shown in FIG. 8. Moreover, at this time, the pawl 160 is pushed upward by a slope of the ratchet groove of the ratchet wheel, and therefore the reset pin 162 of the pawl 160 can abut against a push slope 1721 of the push portion 172 of the reset push part 170. Specifically, by setting one or more of a length of the reset push part 170, a position of the first rotation limiting portion 173 on the ratchet wheel 120, and a position of the first pivotal shaft 171 on the ratchet wheel 120, when the rope sheave 110 rotates in the direction N1, the pawl 160 in the first position can drive or push the reset push part 170 to rotate, in the direction N2 shown in FIG. 7, to an angular position defined by the first rotation limiting portion 173.

When the rope sheave 110 continues to rotate in the direction N1, as shown in FIG. 8, on one hand, the second rotation limiting portion 174 prevents the reset push part 170 from continuously rotating in the direction N2; on the other hand, the pawl 160 and the reset pin 162 thereof are driven by the rope sheave 110 to move with respect to the push slope 1721. At this time, the push slope 1721 exerts, on the reset pin 162, a reaction force approximately perpendicular to the push slope 1721. The reaction force overcomes a tension force of the tension spring 165. The reset pin 162 pushes the pawl 160 to rotate in the direction N3 shown in FIG. 8. Moreover, the pawl tail 164 of the pawl 160 further acts on an inner side of the protruding stop portion 152 and pushes the trip bar 150 to rotate in the direction N4 shown in FIG. 8.

When the rope sheave 110 continues to rotate in the direction N1, after the reset pin 162 of the pawl 160 goes across the top of the push slope 1721, the pawl 160 is pushed to a farthest position away from the ratchet wheel 120, and the top of the pawl tail 164 of the pawl 160 at least slides over the top of the protruding stop portion 152 of the trip bar 150 already. Driven by the torsion spring 153 of the trip bar, the trip bar 150 rotates in a direction N5 shown in FIG. 9; and the pawl 160 returns to the second position shown in FIG. 9. At this time, the outer side of the protruding stop portion 152 of the trip bar 150 contacts the inner side of the pawl tail 164 of the pawl 160, to prevent the pawl 160 from moving and limit the pawl 160 in the second position. It should be noted that, in this case, the top of the push slope 1721 is farthest away from an axial center of the ratchet wheel 120 or the rope sheave 110. Therefore, at the top of the push slope 1721, the reset push part 170 pushes the ratchet wheel 160 to rotate at a maximum angle in the direction N3, and the top is also farthest away from the axial center of the ratchet wheel 120 or the rope sheave 110. When the reset pin 162 on the push slope 1721 is pushed upward to the top of the push slope 1721, the top of the pawl tail 164 of the pawl 160 at least slides over the top of the protruding stop portion 152 of the trip bar 150 already. Therefore, at this time, the pawl 160 at least successively returns to the second position already.

When the rope sheave 110 continues to rotate in the direction N1, as shown in FIG. 10, the reset push part 170 does not contact the reset pin 162 of the pawl 160. The reset push part 170 swings downward, under its own gravity, to an angular position defined by the first rotation limiting portion 173, and also returns to its original position. It should be noted that, even if the rope sheave continues to rotate in the direction N1, because the pawl 160 is limited in the second position and the reset push part 170 returns to the original position, the top of the push slope 1721 comes closer to the axial center of the ratchet wheel 120 or the rope sheave 110 at this time, and the reset push part 170 does not mechanically act on the pawl 160 (especially, the reset push part 170 does not mechanically contact the reset pin 162). Therefore, rotation of the rope sheave 110 of the governor 10 when the elevator is in a normal operation condition is not affected. Moreover, the reset push part 170 that has returned to the original position is ready for a next resetting operation at any time.

It should be construed that, with the above teaching of the embodiment of the present invention, persons skilled in the art may specifically set structural parameters such as a position of the pivotal shaft 171, a length of the reset push part 170, a bevel angle of the push slope 1721, a position of the first rotation limiting portion 173, and/or a position of the second rotation limiting portion 174; and correspondingly, may further specifically set structural parameters such as a position of the reset pin 162, a shape of the pawl tail 164, and/or a shape of the protruding stop portion 152.

The foregoing resetting process is implemented mechanically, and the governor can be automatically reset by driving the rope sheave 110 in the direction N1. Therefore, the implementation is completely independent of manual operations. The governor 10 in this embodiment is extremely applicable to an MRL elevator.

Second Embodiment

A governor 20 of an elevator in the embodiment of the present invention is described in detail below with reference to FIG. 11 to FIG. 16 by using examples.

In this embodiment, the governor 20 is used for triggering corresponding operations when a car of the elevator exceeds a preset speed, so as to limit the speed of the car of the elevator. Therefore, the governor 20 in this embodiment is provided with a rope sheave 110 for monitoring an operation speed of the car. A steel rope (not shown in the figures) is disposed in a rope sheave groove of the rope sheave 110, and when the elevator is in a normal operation condition, the steel rope is synchronized with the monitored car in the vertical movement and drives the rope sheave 110 to rotate simultaneously. For example, when the car goes up, the rope sheave 110 rotates in a counterclockwise direction shown in FIG. 11; and on the contrary, when the car goes down, the rope sheave 110 rotates in a clockwise direction shown in FIG. 11.

The governor 20 is further provided with a ratchet wheel 120 and a centrifugal mechanism 140. The ratchet wheel 120 and the rope sheave 110 are both disposed on a rack 100 of the governor 20. In this embodiment, the ratchet wheel 120 and the rope sheave 110 may be disposed coaxially, but the ratchet wheel 120 stays still when the elevator is in the normal operation condition. Several ratchet grooves are disposed on the circumference of the ratchet wheel 120. An outer diameter of the ratchet wheel 120 is obviously less than that of the rope sheave 110, and the ratchet wheel 120 is disposed on one axial side of the ratchet wheel 120. The centrifugal mechanism 140 may be disposed on the ratchet wheel 120 and located on the other axial side of the ratchet wheel, that is, located on a side opposite to the side provided with the ratchet wheel 120.

The centrifugal mechanism 140 is provided with a centrifugal swing component 141. The centrifugal mechanism 140 starts to work while the ratchet wheel 120 rotates, and as the ratchet wheel 120 accelerates, the centrifugal swing component 141 of the centrifugal mechanism 140 moves, within the ratchet wheel 120, closer to the circumference of the ratchet wheel 120. That is, as the ratchet wheel 120 accelerates, the centrifugal swing component 141 can outwardly reach a farther position in a radial direction of the ratchet wheel 120. In this way, the governor 20 can monitor an operation speed of the car by using the centrifugal mechanism 140. It should be noted that, a specific implementation structure of the centrifugal mechanism 140 is not limited in the embodiment of the present invention. The main function of the centrifugal mechanism 140 is that its action corresponds to a rotation speed of the ratchet wheel 120 and it can mechanically trigger corresponding parts of the governor 20 when the ratchet wheel reaches a particular speed. Any centrifugal mechanism which can implement this function can be used in the governor 20 of the present invention.

In this embodiment, the governor 20 optionally can implement the following function: preventing the elevator from further speeding up when an operation speed of the car of the elevator is greater than or equal to a first limiting speed.

Therefore, an electrical switch 190 is disposed on the governor 20. Specifically, the electrical switch 190 is provided with a protruding trigger arm 191 facing the rope sheave 110. When the operation speed of the car reaches the first limiting speed, a tail end of the centrifugal swing component 141 can reach a first radial position in a radial direction of the rope sheave 110, rotate, and mechanically act on the trigger arm 190 in the first radial position, to trigger the electrical switch 190 to disconnect a safety circuit, so as to brake the car by using, for example, a holding brake of a traction machine.

In this embodiment, the governor 20 can further implement the following function: mechanically actuating a safety gear disposed on the car when the operation speed of the car of the elevator is greater than or equal to a second limiting speed, so as to brake the car emergently. The reason is that, the electrical switch 190 probably fails to operate normally and becomes unreliable when braking is triggered by using the electrical switch 190. Therefore, the governor 20 needs to actuate the safety gear in a completely mechanical manner, so as to avoid an extreme accident, such as the falling of the car, in the most reliable manner. The second limiting speed is greater than the first limiting speed, and their values may be correspondingly set according to a specific application of the elevator.

Figure 11:
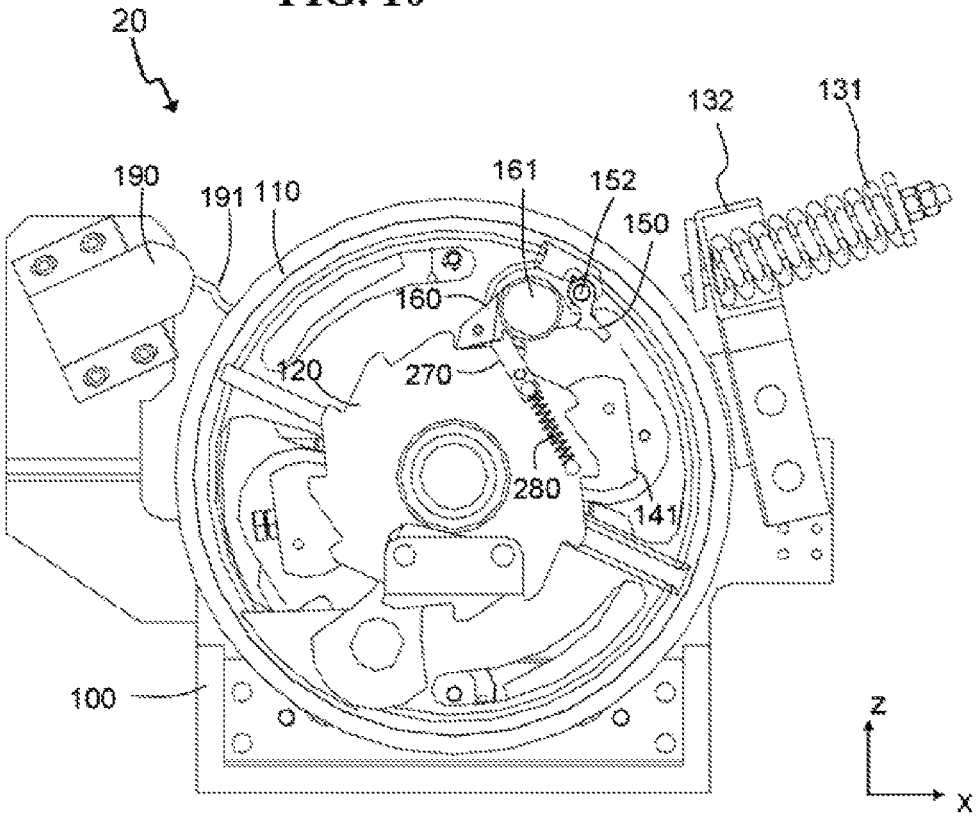
FIG. 11 is a front view of a governor according to a second embodiment of the present invention, wherein the governor works in a second state.
Figure 14:
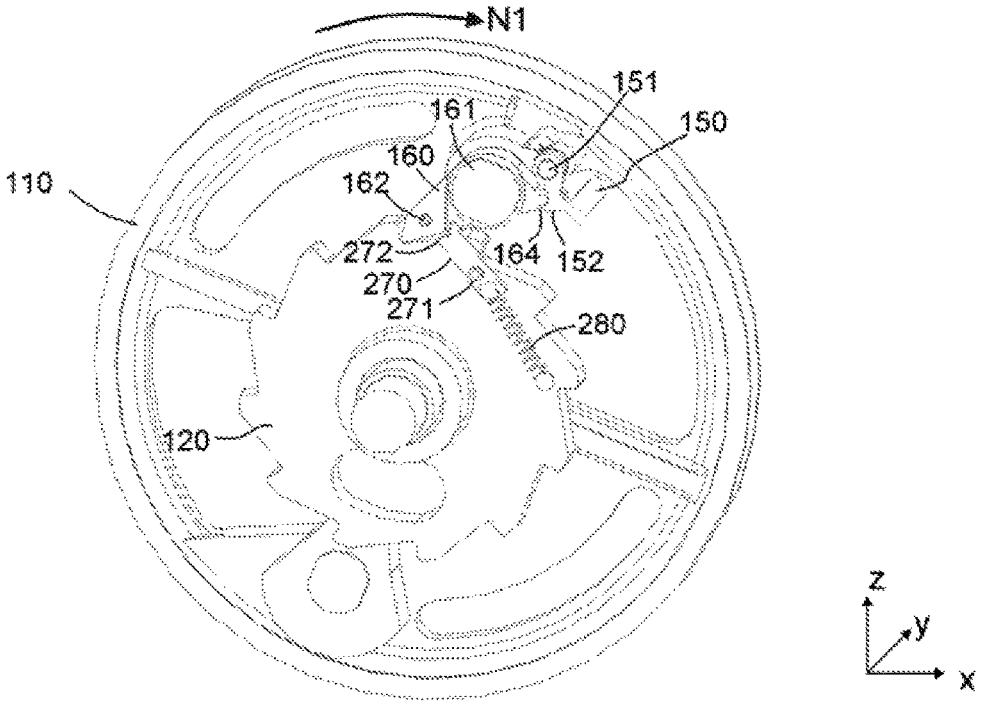
FIG. 14 to FIG. 16 show a resetting operation process in which the governor in the second embodiment of the present invention is reset from the second state shown in FIG. 11 to the first state shown in FIG. 12.

Therefore, the governor 20 is provided with corresponding parts for mechanically actuating the safety gear, specifically including a trip bar 150 and a pawl 160 which are disposed on the rope sheave 110, and further including a braking spring 131, a rope-pressing holder 132, and a pull rod 133. In one embodiment, the trip bar 150 is disposed near an edge of the circumference of the rope sheave 110 and can rotate with respect to the rope sheave 110, and a pivotal shaft 151 of the trip bar is disposed on the rope sheave 110 along a y direction. The pawl 160 is disposed near the trip bar 150 and on the same side with the ratchet wheel 120, and can rotate with respect to the rope sheave 110. A pivotal shaft 161 of the pawl is disposed on the rope sheave 110 along the y direction. Two ends of the pawl 160 are a pawl head 163 and a pawl tail 164 respectively, and can both rotate about the pivotal shaft 161. When the operation speed of the car reaches the second limiting speed, the tail end of the centrifugal swing component 141 can reach a second radial position (the second radial position is farther away from an axial center of the rope sheave 110 than the first radial position) in the radial direction of the rope sheave 110, rotate, and mechanically act on the trip bar 150 in the second radial position. The trip bar 150 then triggers the pawl 160 to rotate, and the pawl head 163 falls into the ratchet groove (as shown in FIG. 11 and FIG. 14) of the ratchet wheel 120. In this case, the rotation of the rope sheave 110 is limited by the ratchet wheel 120 and the rope sheave 110 exerts a reaction force on the ratchet wheel 120. The ratchet wheel 120 transfers the reaction force to the pull rod 133, to draw the rope-pressing holder 132 closer to the rope sheave 110 till it presses against the steel rope of the rope sheave 110. A friction between the rope-pressing holder 132 and the steel rope may be converted into an upward pull force acting on the steel rope. Therefore, the safety gear disposed on the other end of the steel rope may be actuated under the effect of the pull force, to achieve emergency braking.

Figure 12:
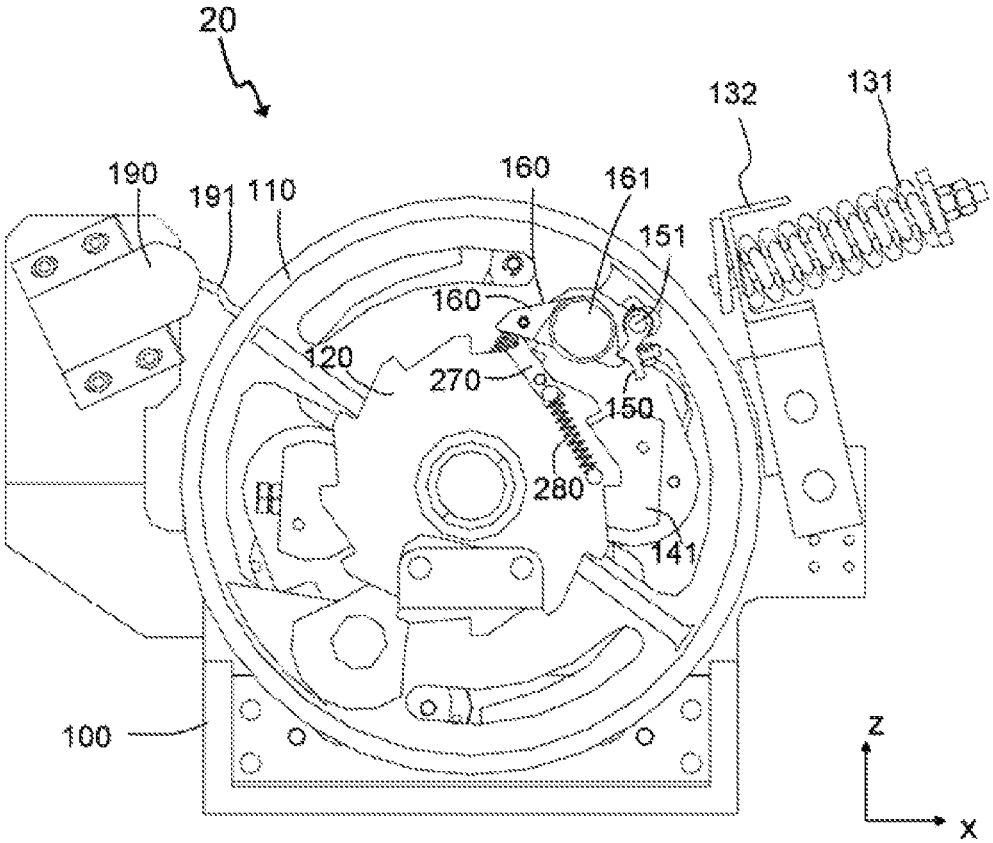
FIG. 12 is a front view showing that the governor shown in FIG. 11 works in a first state.
Figure 16:
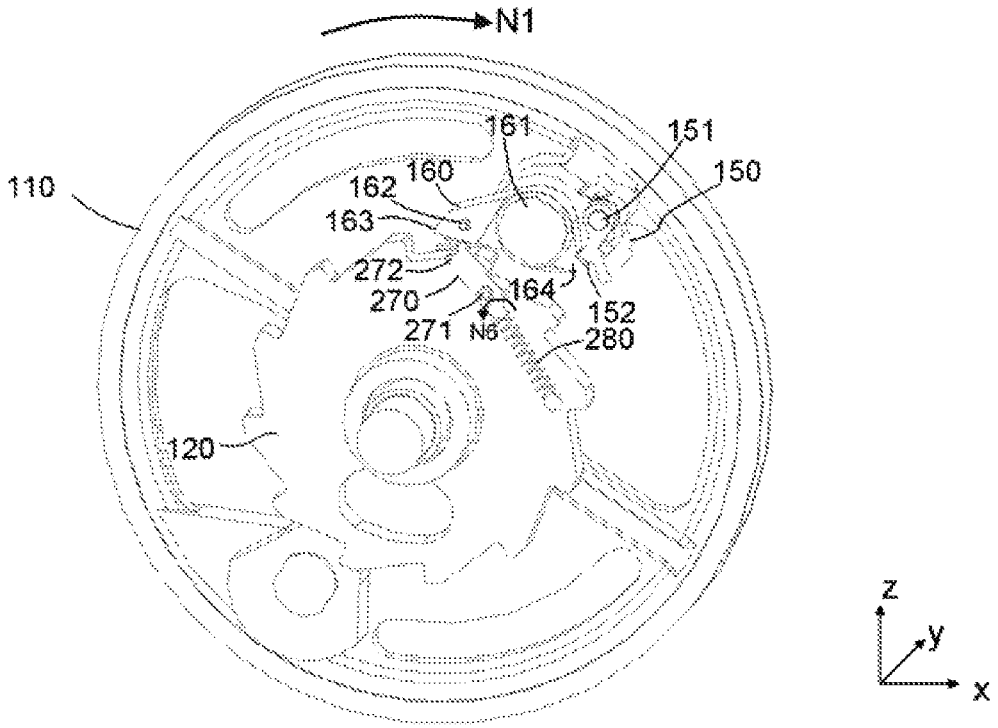

Herein, a first state and a second state of the governor 20 are defined. In the first state (as shown in FIG. 12 and FIG. 16), the rope sheave 110 can freely rotate with respect to the ratchet wheel 120, and correspondingly, an operation speed of the car is less than the aforementioned second limiting speed. In the second state (as shown in FIG. 11 and FIG. 14), the pawl 160 is located in a first position in which a pawl head 163 thereof mechanically acts on the ratchet wheel 120, so that rotation of the rope sheave 110 in a first direction (for example, the counterclockwise direction in FIG. 1) can act on the ratchet wheel 120 via the pawl head 163. In the second state, rotation of the rope sheave 110 is obviously limited by the ratchet wheel 120, thereby producing the pull force.

Figure 13:
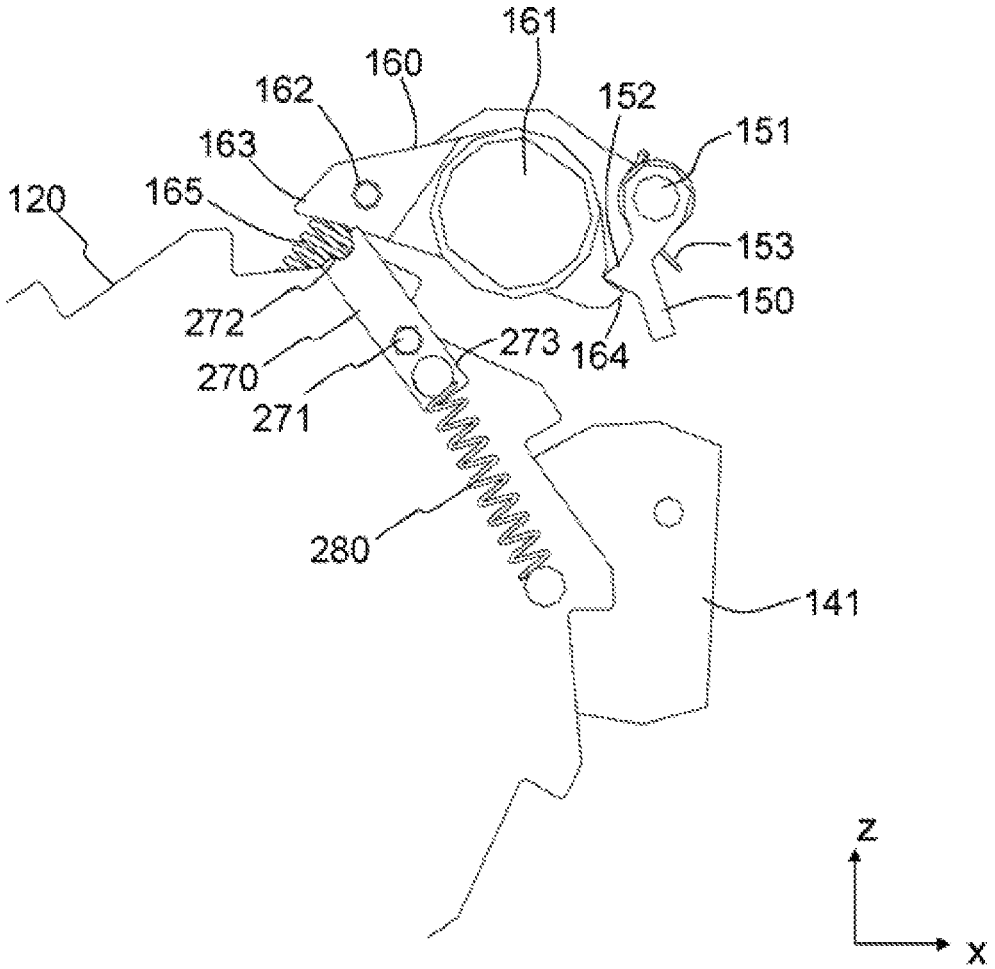
FIG. 13 is a schematic structural diagram of key parts of the governor shown in FIG. 12.

In one embodiment, specific structures of the trip bar 150 and the pawl 160 are set as shown in FIG. 13 to FIG. 16. The whole trip bar 150 rotates about the pivotal shaft 151, and therefore can rotate with respect to the rope sheave 110. The trip bar 150 is provided with a protruding stop portion 152 facing the pawl tail 164 of the pawl 160. In the first state shown in FIG. 12, the protruding stop portion 152 may limit the pawl 160 in a second position and prevent the pawl 160 from rotating. The pawl 160 can freely rotate with respect to the ratchet wheel 120 in the second position. Correspondingly, the pawl tail 164 on one end of the pawl 160 may specifically be, but not limited to, hook-shaped. In the first state (as shown in FIG. 13 and FIG. 16), an inner side of the hook of the pawl tail 164 interacts with an outer side of the protruding stop portion 152 of the trip bar 150; and in the second state (as shown in FIG. 11 and FIG. 14), an outer side of the hook of the pawl tail 164 interacts with an inner side of the protruding stop portion 152 of the trip bar 150.

Figure 15:
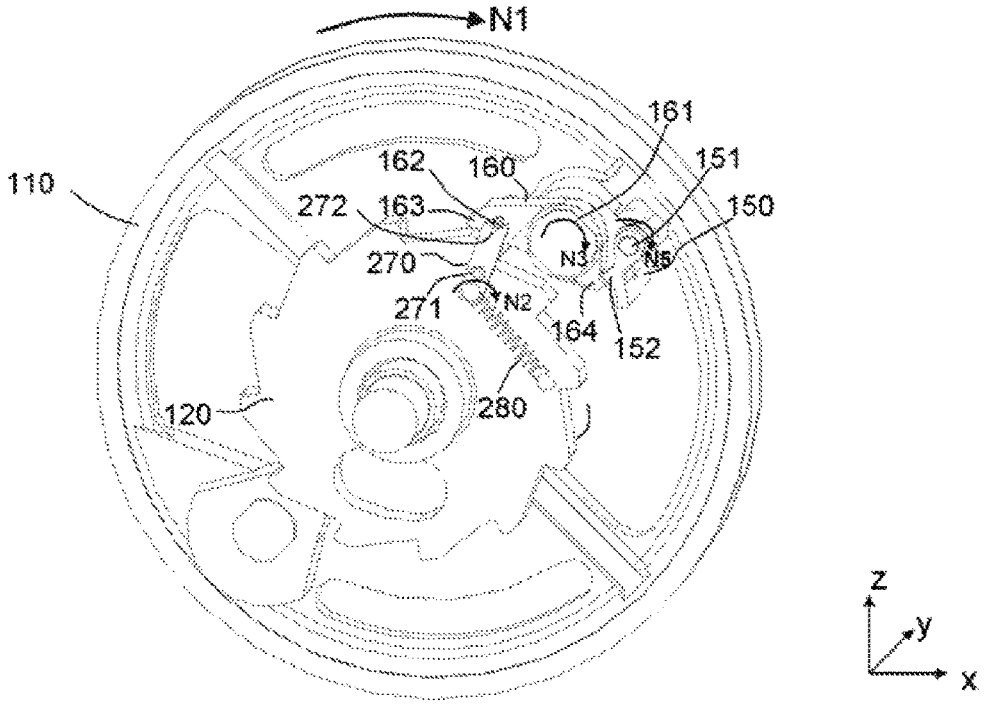

Moreover, in this embodiment, a torsion spring 153 corresponding to the trip bar 150 is disposed on the pivotal shaft 151 of the trip bar, and under the effect of a force exerted by the torsion spring 153, the trip bar 150 may rotate about the pivotal shaft 151 at a particular angle in a direction N5 shown in FIG. 15. A tension spring 165 corresponding to the pawl 160 is disposed on the pawl head 163, and under the effect of a force exerted by the tension spring 165, the pawl 160 may be pulled to rotate about the pivotal shaft 161 at a particular angle in a direction opposite to a direction N3, as shown in FIG. 15.

Specifically, when the elevator is in a normal operation condition, the governor 20 is in the first state; and blocked by the trip bar 150, the pawl 160 is located in the second position. When the operation speed of the car reaches the second limiting speed, the centrifugal swing component 141 swings outwardly to a second radial position where the trip bar 150 can be triggered, and drives the trip bar 150 to rotate at a particular angle in a direction opposite to the direction N5 shown in FIG. 15, till the protruding stop portion 152 of the trip bar 150 cannot block the pawl tail 164 of the pawl 160. In this case, the tension spring 165 pulls the pawl 160 to rotate about the pivotal shaft 161 at a particular angle in a direction opposite to the direction N3, as shown in FIG. 15, the pawl head 163 of the pawl 160 falls into the ratchet groove of the ratchet wheel 120, the pawl 160 is located in the first position, and correspondingly, the governor 20 is in the second state. In the process illustrated above, the governor 20 completes a mechanical setting operation. A basic process is as follows: After the car reaches the second limiting speed, the trip bar 150 is triggered by the centrifugal swing component 141, and the pawl 160 rotates at a particular angle in the second position to jump to the first position.

Continue to refer to FIG. 11 to FIG. 16. The governor 20 in the embodiment of the present invention further has an automatic mechanical resetting function. A resetting process refers to that the governor 20 returns from the second state shown in FIG. 1 to the first state shown in FIG. 12, and correspondingly, the pawl 160 rotates at a particular angle in the first position and then returns to the second position.

Therefore, in the governor 20 in this embodiment, the ratchet wheel 120 is further provided with a reset push part 270 for resetting the governor 20 from the second state to the first state. In this embodiment, the reset push part 270 is rotatably fixed on the ratchet wheel 120 by using the pivotal shaft 271, one end of the reset push part 270 is a push portion 272, the other end of the reset push part 270 is a push rod tail 273, and the pivotal shaft 271 is positioned in the middle of the reset push part 270 and is close to the end provided with the push rod tail 273. In order that the reset push part 270 can return to an original position shown in FIG. 13 after the resetting operation, a reset tension spring 280 is correspondingly disposed on the ratchet wheel 120. One end of the reset tension spring 280 is fixed on the ratchet wheel 120 and the other end is connected to the push rod tail 273 of the reset push part 270. Pulled by the reset tension spring 280, the reset push part 270 easily returns to a position on a line formed by the fixed end of the reset tension spring 280 and the pivotal shaft 271, that is, the original position shown in FIG. 13. It should be noted that, the reset tension spring 280 is not limited to a spring form, and may be an elastic part of any other form capable of pulling the reset push part 270.

The resetting operation process of the governor 20 in the embodiment of the present invention is described by using an example below with reference to FIG. 14 to FIG. 16. Furthermore, specific settings and operation principles of the reset push part 270 and other parts are described.

First, the rope sheave 110 may be driven to rotate in a direction N1; the trip bar 150 and the whole pawl 160 rotate with respect to the ratchet wheel also in the direction N1, and reach a position shown in FIG. 14 after rotating by a particular angle with respect to the reset push part 270. Pulled by the reset tension spring 280, the reset push part 270 stays in the original position during this process.

When the rope sheave 110 continues to rotate in the direction N1, the reset pin 162 on the pawl 160 contacts the push portion 272 when passing through the push portion 272 of the reset push part 270. In this embodiment, the push portion 272 is provided with a groove, and therefore, the reset pin 162 falls into the groove of the push portion 272 at this time, and the pawl 160 continues to rotate with respect to the ratchet wheel 120 in the direction N1 to drive the reset push part 270 to rotate in a direction N2 shown in FIG. 15. Moreover, because the reset pin 162, the pivotal shaft 271, and an axial center of the ratchet wheel 120 are not on the same line, the reset pin 162, the pivotal shaft 271, and the axial center of the ratchet wheel 120 gradually move to the same line as the reset push part 270 rotates in the direction N2. The push portion 272 pushes the reset pin 162 upward, so as to push the pawl 160 to rotate in a direction N3 shown in FIG. 15. Meanwhile, the pawl tail 164 of the pawl 160 also acts on the inner side of the protruding stop portion 152 and pushes the trip bar 150 to rotate in a direction opposite to a direction N4 shown in FIG. 15.

Specifically, a length of the reset push part 270 and/or a position of a second end of the reset tension spring 280 on the ratchet wheel 120 may be set, so that when the rope sheave 110 rotates in the direction N1, the pawl 160 in the first position can drive the reset push part 270 to rotate.

When the rope sheave 110 continues to rotate in the direction N1, as shown in FIG. 15, the reset push part 270 continues to rotate in the direction N2, and the pawl 160 is pushed to rotate in the direction N3 till the top of the pawl tail 164 of the pawl 160 slides over the top of the protruding stop portion 152 of the trip bar 150. Driven by the torsion spring 153 of the trip bar, the trip bar 150 rotates in the direction N5 shown in FIG. 15, and the pawl 160 returns to the second position shown in FIG. 15. At this time, the outer side of the protruding stop portion 152 of the trip bar 150 contacts the inner side of the pawl tail 164 of the pawl 160, to prevent the movement of the pawl 160 and limit the pawl 160 in the second position. It should be noted that, when the reset push part 270 and the axial center of the ratchet wheel 120 are on the same line, the push portion 272 of the reset push part 270 is farthest away from the axial center of the ratchet wheel 120. Therefore, before the reset push part 270 moves in the direction N2 to a position on the same line with the axial center of the ratchet wheel 120, the pawl 160 is constantly pushed by the reset push part 270 to rotate in the direction N3. When the reset push part 270 moves in the direction N2 to a position on the same line with the axial center of the ratchet wheel 120, the reset pin 162 is farthest away from the axial center of the ratchet wheel 120. At this time, the pawl 160 is already driven to return to the second position.

When the rope sheave 110 continues to rotate in the direction N1, as shown in FIG. 16, after the pawl returns to the second position, the reset pin 162 on the pawl 160 is separated from the groove of the push portion 272 of the reset push part 270. In this case, pulled by the reset tension spring 280, the reset push part 270 rotates in a direction N6 shown in FIG. 16, and also returns to its original position. It should be noted that, even if the rope sheave continues to rotate in the direction N1, because the pawl 160 is limited in the second position and the reset push part 270 also returns to the original position, the reset push part 270 does not mechanically act on the pawl 160 (especially, the reset push part 270 does not mechanically contact the reset pin 162). Therefore, rotation of the rope sheave 110 of the governor 20 when the elevator is in a normal operation condition is not affected. Moreover, the reset push part 270 that has returned to the original position is ready for a next resetting operation at any time.

It should be appreciated that, with the above teaching of the embodiment of the present invention, persons skilled in the art may specifically set structural parameters such as a position of the pivotal shaft 271, a length of the reset push part 270, and/or a shape of the groove of the push portion 272; and correspondingly, may further set structural parameters such as a position of the reset pin 162, a shape of the pawl tail 164, and/or a shape of the protruding stop portion 152. The reset push part 270 may be, but is not limited to, a plate-like reset push plate.

The foregoing resetting process is implemented mechanically, and the governor can be automatically reset by driving the rope sheave 110 in the direction N1. Therefore, the implementation is completely independent of manual operations. The governor 20 in this embodiment is extremely applicable to an MRL elevator.

It should be appreciated that, directional terms such as "inside", "outside", "up", and "down" are used in the disclosure are relative concepts, are used for relative descriptions and explanations, and may be correspondingly changed according to a position change of the governor.

The foregoing examples mainly describe various kinds of governors of the present invention. Although only some embodiments of the present invention are described, persons with ordinary skill in the art should understand that the present invention can be implemented in many other forms without departing from the principle and scope of the present invention. Therefore, the described examples and embodiments are considered to be illustrative rather than restrictive, and various modifications and replacements may be made to the present invention without departing from the spirit and scope defined in the appended claims.

What is claimed is:

1. A governor (10, 20) of an elevator, comprising a rope sheave (110); a ratchet wheel (120); and a centrifugal mechanism (140), a trip bar (150), and a rotatable pawl (160) which are mounted on the rope sheave (110), the governor (10, 20) being able to work in a first state in which the rope sheave (110) freely rotates with respect to the ratchet wheel (120) or in a second state in which a safety gear is actuated; in the second state, the pawl (160) being located in a first position in which a pawl head (163) thereof mechanically acts on the ratchet wheel (120), so that rotation of the rope sheave (110) in a first direction can act on the ratchet wheel (120) via the pawl head (163);

wherein the governor (10, 20) further comprises a reset push part (170, 270) which is disposed on the ratchet wheel (120) and used for resetting the governor (10, 20) from the second state to the first state, wherein the reset push part (170, 270) and the pawl (160) are set in such a manner that when the rope sheave (110) rotates in a second direction (N1) opposite to the first direction, the reset push part (170, 270) pushes the pawl (160) to reset the pawl (160) to a position corresponding to the first state.

2. The governor according to claim 1, wherein when the governor (10, 20) is in the first state, the trip bar (150) limits the pawl (160) to a second position in which the pawl (160) can freely rotate with respect to the ratchet wheel (120), and the reset push part (170, 270) is located in an original position in which the reset push part does not mechanically act on the pawl (160);

wherein, when the rope sheave (110) rotates in the second direction opposite to the first direction, a push portion (172, 272) of the reset push part (170, 270) pushes the pawl (160) and resets the pawl (160) to the second position, and the reset push part (170, 270) is automatically reset to the original position.

3. The governor (10) according to claim 2, wherein the reset push part (170, 270) is rotatably disposed on the ratchet wheel (120) with respect to a first pivotal shaft (171, 271) of the reset push part.

4. The governor (10) according to claim 3, wherein the ratchet wheel (120) is further provided with a first rotation limiting portion (173) and a second rotation limiting portion (174), and the reset push part (170) can swing between the first rotation limiting portion (173) and the second rotation limiting portion (174);

wherein, an angular position which is defined by the first rotation limiting portion (173) and to which the reset push part (170) swings is the original position; one or more of a length of the reset push part (170), a position of the first rotation limiting portion (173) on the ratchet wheel (120), and a position of the first pivotal shaft (171) on the ratchet wheel (120) are set, so that when the rope sheave (110) rotates in the second direction (N1) opposite to the first direction, the pawl (160) in the first position can drive the reset push part (170) to rotate to the angular position defined by the first rotation limiting portion (173).

5. The governor (10) according to claim 4, wherein a position of the second rotation limiting portion (174) on the ratchet wheel (120) and/or a position of the first pivotal shaft (171) on the ratchet wheel (120) is set, so that when the pawl (160) is in the second position, the reset push part (170) can automatically return to the original position under its own gravity.

6. The governor (10) according to claim 4, wherein the push portion (172) is provided with a push slope (1721), and the pawl (160) is provided with a reset pin (162);

wherein, when the pawl (160) in the second position drives the reset push part (170) to rotate to the angular position defined by the first rotation limiting portion (173), the reset pin (162) of the pawl (160) abuts against the push slope (1721).

7. The governor (10) according to claim 6, wherein when the rope sheave (110) rotates in the second direction (N1) opposite to the first direction, the push slope (1721) exerts a reaction force on the reset pin (162) abutting against the push slope, to push the pawl (160) to rotate to return to the second position.

8. The governor (10) according to claim 7, wherein when the reset pin (162) on the push slope (1721) is pushed upward to the top of the push slope (1721), the pawl (160) at least returns to the second position already.

9. The governor (10, 20) according to claim 6, wherein the reset pin (162) is disposed on the pawl head (163) of the pawl (160), and the pawl head (163) is provided with a tension spring (165).

10. The governor (10) according to claim 7, wherein when the reset push part (170) is located in an angular position defined by the second rotation limiting portion (174), the top of the push slope (1721) is farthest away from an axial center of the ratchet wheel (120).

11. The governor (20) according to claim 3, wherein a reset tension spring (280) is further disposed on the ratchet wheel (120), and is at least used for making the reset push part (270) return to the original position when the pawl (160) is in the second position.

12. The governor (20) according to claim 11, wherein a first end of the reset tension spring (280) is connected to a push rod tail (273) of the reset push part (270), and a second end of the reset tension spring (280) is fixed on the ratchet wheel (120); and a length of the reset push part (270) and/or a position of the second end of the reset tension spring (280) on the ratchet wheel (120) is set, so that when the rope sheave (110) rotates in the second direction (N1) opposite to the first direction, the pawl (160) in the first position can drive the reset push part (270) to rotate.

13. The governor (20) according to claim 11, wherein the pawl (160) is provided with a reset pin (162) and the push portion (272) is provided with a groove, and when the rope sheave (110) rotates in the second direction (N1) opposite to the first direction, the reset pin (162) of the pawl (160) in the first position can fall into the groove and drive the reset push part (270) to rotate.

14. The governor (20) according to claim 13, wherein when the reset pin (162) falls into the groove, the reset pin (162), the pivotal shaft (271), and the axial center of the ratchet wheel (120) are not on the same line; the reset pin (162), the pivotal shaft (271), and the axial center of the ratchet wheel (120) gradually move to the same line in a process in which the reset pin (162) drives the reset push part (270) to rotate, so that the groove pushes the reset pin (162) to rotate away from the ratchet wheel (120), to make the pawl to return to the second position.

15. The governor (20) according to claim 14, wherein in the process in which the reset pin (162) drives the reset push part (270) to rotate, when the reset pin (162), the pivotal shaft (271), and the axial center of the ratchet wheel (120) are on the same line, the pawl (160) at least returns to the second position already.

16. The governor (20) according to claim 14, wherein when the reset pin (162), the pivotal shaft (271), and the axial center of the ratchet wheel (120) are on the same line, the reset pin (162) is farthest away from the axial center of the ratchet wheel (120).

17. The governor (10, 20) according to claim 2, wherein a second pivotal shaft (161) is disposed corresponding to the pawl (160), and the pawl (160) can rotate about the second pivotal shaft (161) between the first position and the second position on the ratchet wheel (120).

18. The governor (10, 20) according to claim 2, wherein the pawl (160) is provided with a hook-shaped pawl tail (164); the trip bar (150) is provided with a protruding stop portion (152) facing the pawl tail (164); and when the pawl (160) is in the second position, the protruding stop portion (152) stops the pawl tail (164) to limit the pawl (160) in the second position.

19. The governor (10, 20) according to claim 18, wherein a centrifugal swing component (141) of the centrifugal mechanism (140) is set to mechanically trigger the trip bar (150) when a car of the elevator reaches a preset limit speed, so as to release the pawl tail (164) from the limit of the protruding stop portion (152).

20. The governor (10, 20) according to claim 1, wherein a third pivotal shaft (151) is disposed corresponding to the trip bar (150), and the third pivotal shaft (151) is provided with a torsion spring (153).

21. The governor (10, 20) according to claim 1, wherein the ratchet wheel (120) and the rope sheave (110) are coaxially disposed on a rack (100) of the governor (10, 20).

22. The governor (10, 20) according to claim 1, wherein the governor (10, 20) is further provided with an electrical switch (190).

23. The governor (10, 20) according to claim 1, wherein the governor (10, 20) is further provided with a braking spring (131), a rope-pressing holder (132), and a pull rod (133).

24. An elevator, using the governor (10, 20) according to claim 1.

25. The elevator according to claim 24, wherein the elevator is a machine room-less elevator.

* * * * *